US006650209B2

(12) United States Patent
Plummer et al.

(10) Patent No.: US 6,650,209 B2
(45) Date of Patent: Nov. 18, 2003

(54) RF COAXIAL CONNECTOR AND METHOD INCLUDING A PARTICLE COLLECTING HOOD

(75) Inventors: Cole Nason Plummer, South Casco, ME (US); Lauris Dean Waterhouse, Raymond, ME (US)

(73) Assignee: SPX Corporation, Charlotte, NC (US)

( * ) Notice: Subject to any disclaimer, the term of this patent is extended or adjusted under 35 U.S.C. 154(b) by 84 days.

(21) Appl. No.: 09/840,907

(22) Filed: Apr. 25, 2001

(65) Prior Publication Data

US 2002/0158721 A1 Oct. 31, 2002

(51) Int. Cl.[7] ..... H01P 1/02

(52) U.S. Cl. ..... 333/245; 333/260; 439/578; 439/585; 174/88 C

(58) Field of Search ..... 333/260, 245; 439/578, 585, 519, 521; 174/88 C

(56) References Cited

U.S. PATENT DOCUMENTS

| | | | | | |
|---|---|---|---|---|---|
| 2,822,418 | A | * | 2/1958 | Dinnick | 333/260 X |
| 3,828,303 | A | * | 8/1974 | Sladek et al. | 333/33 |
| 4,824,400 | A | * | 4/1989 | Spinner | 333/260 X |
| 5,401,173 | A | * | 3/1995 | Grandchamp et al. | 333/260 X |

* cited by examiner

*Primary Examiner*—Benny Lee
(74) *Attorney, Agent, or Firm*—Baker & Hostetler

(57) ABSTRACT

An apparatus and method is provided for connecting together sections of a coaxial radio frequency transmission line. The system includes a multiple finger contact radially deformable along its axial length that may be resiliently supported in the radial direction by multiple finger contact spring rings. A hood is provided to catch metallic particles given off by the frictional wear of the contact.

20 Claims, 6 Drawing Sheets

RF COAXIAL CONNECTOR AND METHOD INCLUDING A PARTICLE COLLECTING HOOD

FIELD OF THE INVENTION

The invention pertains to an apparatus and method for connecting together sections of a coaxial radio frequency transmission line.

BACKGROUND OF THE INVENTION

Various arrangements are known for connecting together two sections of a radio frequency transmission line. In the case of sectional coaxial transmission lines, it is desirable to have a connector that can electrically connect the coaxial inner conductor portions of adjacent sections.

One problem with prior connectors is that they sometimes require a relatively high insertion force in order to achieve the desired degree of electrical contact. Another problem is that when the coaxial lines are arranged vertically, a connector can disperse undesirable metallic particles onto the insulator of the conductor.

Accordingly, there is a need in the art for a coaxial connector that can provide a relatively low insertion force with a relatively high electrical contact and that can avoid disbursing metallic conductive particles on the insulator.

SUMMARY OF THE INVENTION

In one aspect of the invention, an apparatus is provided which connects a first coaxial transmission line section to a second coaxial transmission line section. The apparatus comprises an inner conductor body mounted to the first coaxial inner conductor. A connector sleeve is mounted to the inner conductor body, and an annular multiple finger contact element, which has a total axial length and is deformable in the radial direction along the entire total axial length, is mounted to the connector sleeve and surrounds at least a portion of the connector sleeve. At least one annular multiple finger spring ring is disposed between the connector sleeve and the multiple finger contact to resiliently support the multiple finger contact, and the multiple finger contact is insertable into the second coaxial inner conductor in order to provide a contact with the inner conductor.

In another aspect of the invention, a multiple finger contact element is provided that has fingers that extend along the total axial length of the contact.

In another aspect of the invention, a hood is provided to catch the metallic particles resulting from wear due to movement of the contact.

There has thus been outlined, rather broadly, the more important features of the invention in order that the detailed description thereof that follows may be better understood, and in order that the present contribution to the art may be better appreciated. There are, of course, additional features of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein, as well as the abstract included below, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION OF THE INVENTION

The present invention provides a connector and method for connecting coaxial transmission line sections, and more particularly for electrically connecting the inner conductors of coaxial transmission line sections.

Figure 1:
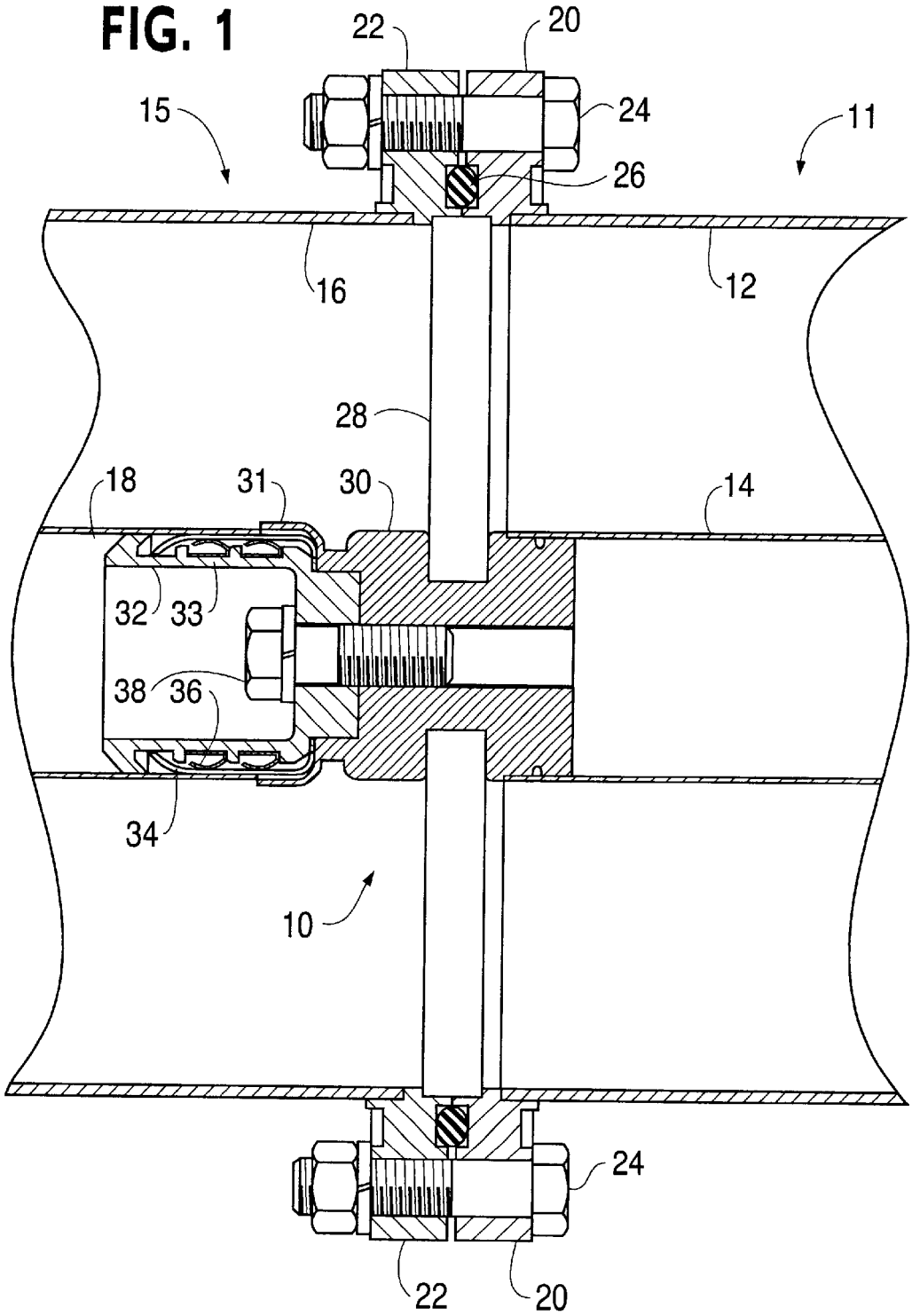
FIG. 1 is a side sectional view of a connector according to a preferred embodiment of the invention shown connecting two coaxial transmission line sections.

Referring now to FIG. 1, a connector assembly 10 is used to connect a first coaxial transmission line section 11 having a first coaxial outer conductor 12 and a first coaxial inner conductor 14 to a second coaxial transmission line section 15 having a second coaxial outer conductor 16 and a second inner conductor 18. A flange 20 on the first line section 11 is connected to a flange 22 on the second line section 15 by a bolt or other fastener 24. This provides a mechanical and electrical connection between the outer coaxial conductors 12 and 16.

An O-ring 26 may be provided in grooves in the flanges 20 and 22 in order to provide a seal against environmental conditions for the interior of the coaxial line sections. An anchor insulator 28 is provided as shown to position the inner conductor 30 in a radially centered position and insulate it from the outer conductors.

Positioned in a central bore in the anchor insulator 28 is an inner conductor body 30. The inner conductor body 30 has a hood extension 31 which is discussed in more detail below. The connector 10 also includes a connector sleeve 32 having annular grooves 33. A multiple finger contact element 34 generally surrounds a portion of the connector sleeve 32 and multiple finger spring rings 36 are set into the grooves 33 and provide a resilient springback to the multiple finger contact 34. A bolt 38 attaches the connector sleeve 32 to the inner conductor body 30 as shown. This connection also traps the multiple finger contact 34 in place.

Figure 2:
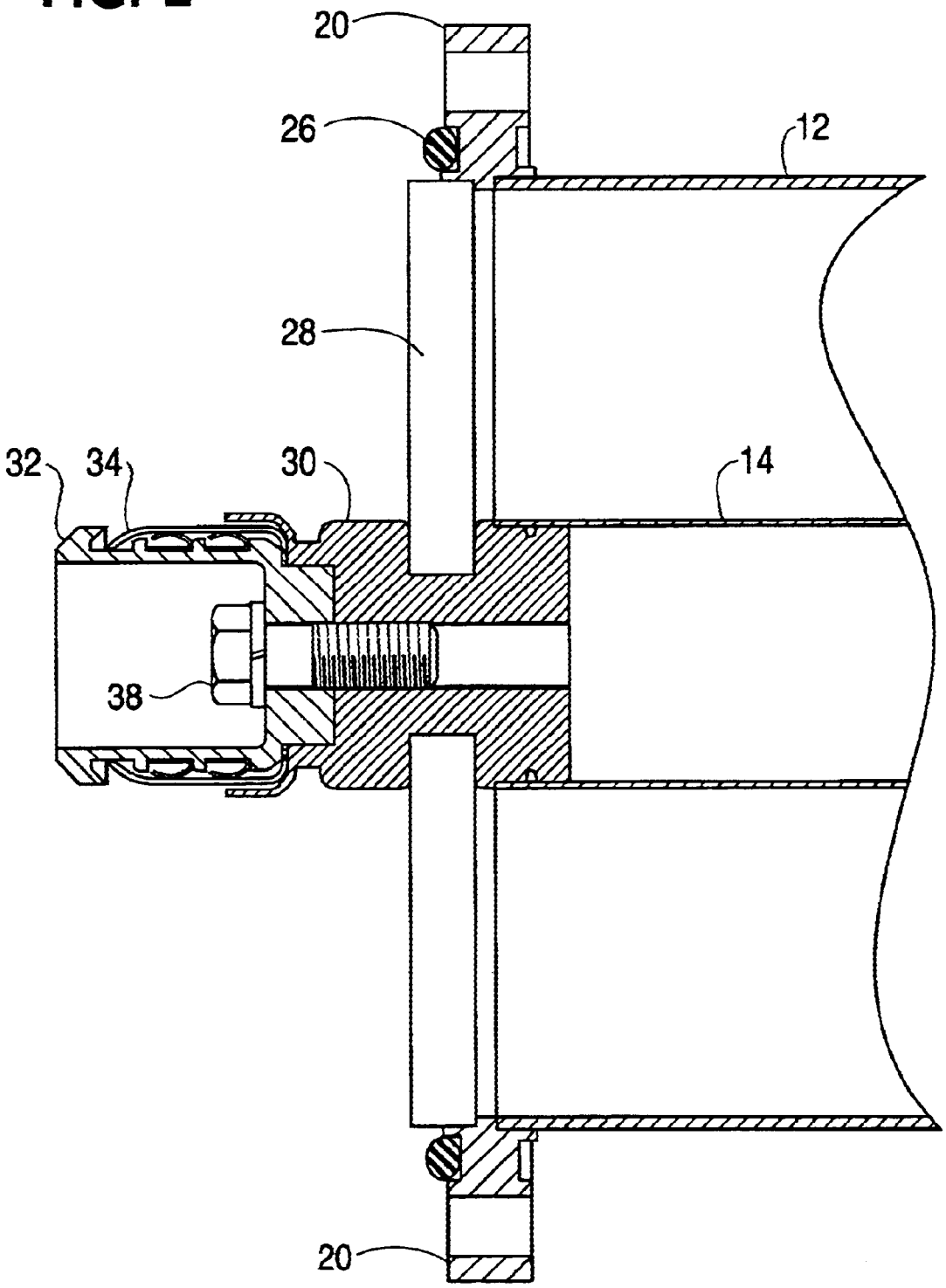
FIG. 2 is a side sectional view showing a connector according to the embodiment of FIG. 1 installed on one end of a coaxial transmission line section before connection to a second coaxial transmission line section.

FIG. 2 shows the assembly according to FIG. 1 when it is mounted to the first coaxial transmission line section and before the first coaxial transmission line section is connected to a second coaxial transmission line section. The individual line sections, in some embodiments, may be distributed to the end user in this configuration. It will be appreciated that the end user can then connect the line sections together by simply inserting the connector 10 into the second coaxial inner conductor of a second coaxial transmission line section, and tightening the bolts 24 on the flanges 20 and 22, as shown in FIG. 1.

Figure 3:
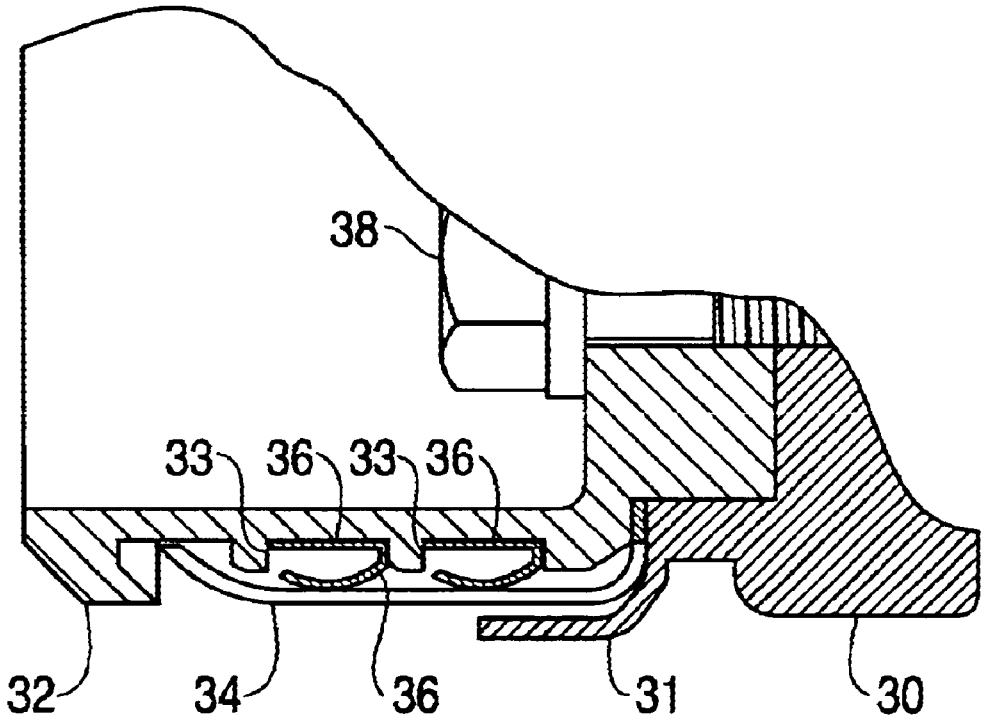
FIG. 3 is a detailed cut away cross sectional view illustrating a connector according to the embodiment of FIG. 1.
Figure 4:
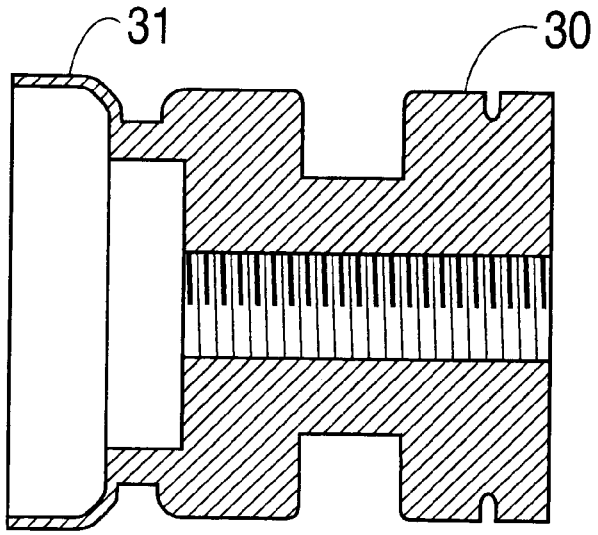
FIG. 4 is a cross sectional view of an inner conductor body.
Figure 5:
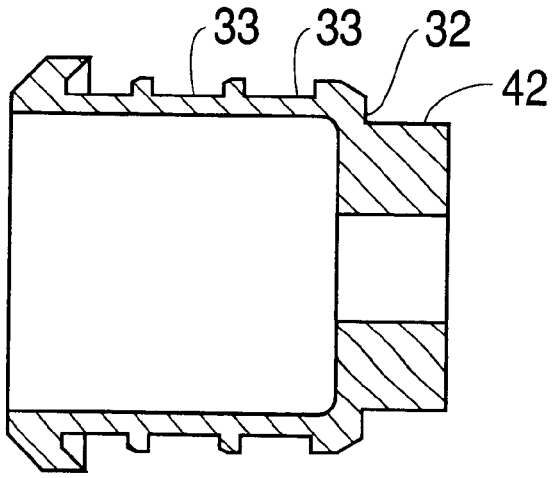
FIG. 5 is a cross sectional view of a connector sleeve.

FIG. 3 is a detailed cutaway view showing in cross section the arrangement of the inner conductor body 30, hood extension 31, connector sleeve 32, grooves 33, and multiple finger contact 34. FIG. 4 shows the inner conductor body 30. FIG. 5 shows the sleeve 32 and the grooves 33.

Figure 6A:
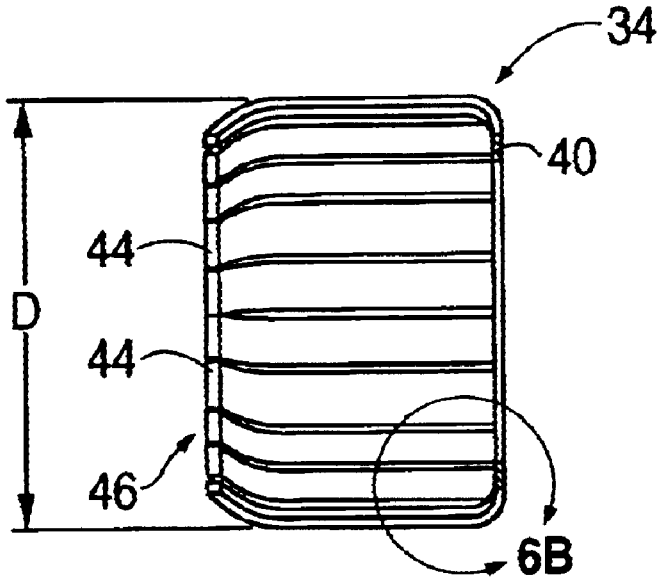
FIG. 6A is a cutaway side view of a multiple finger contact element.
Figure 6B:
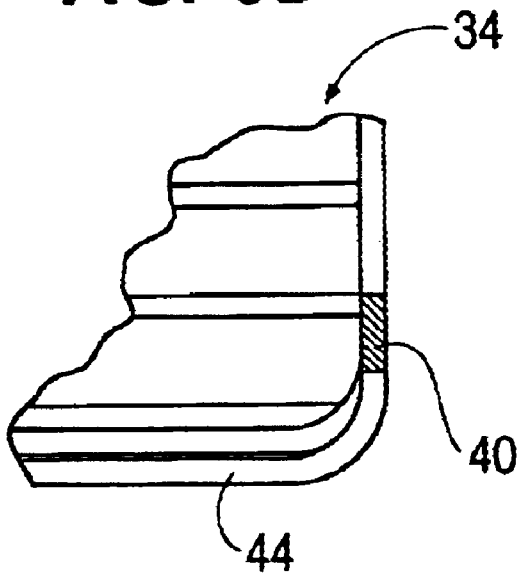
FIG. 6B is a detailed cutaway side view of the multiple finger contact element.

FIGS. 6A and 6B show the multiple finger contact 34 in greater detail. The multiple finger contact 34 is an annular element having a continuous circular band 40 which has an inner diameter just greater than the outer diameter of the rear portion 42 of the connector sleeve. Extending longitudinally outward from this circular band 40 are a plurality of flexible finger elements 44 that are free to flex to change the radial diameter D of the fingers. The finger elements 44 extend from the free ends 46 of the fingers at one axial end of the multiple finger contact element 34 to the circular band at the other axial end of the multiple finger contact 34 as shown in FIG. 6A.

FIG. 6A shows that the finger elements 44 extend along the entire total axial length of the multiple finger contact 34, because the fingers 44 are separate until they end in the continuous circular band 40. This provides a significant advantage of to invention, because the multiple finger contact 34 can flex radially at any point or points along its entire axial length. This permits the multiple finger contact 34 to make satisfactory electrical contact with the inner conductor 18, (FIG. 1), while keeping a desirably low insertion force.

Figure 7:
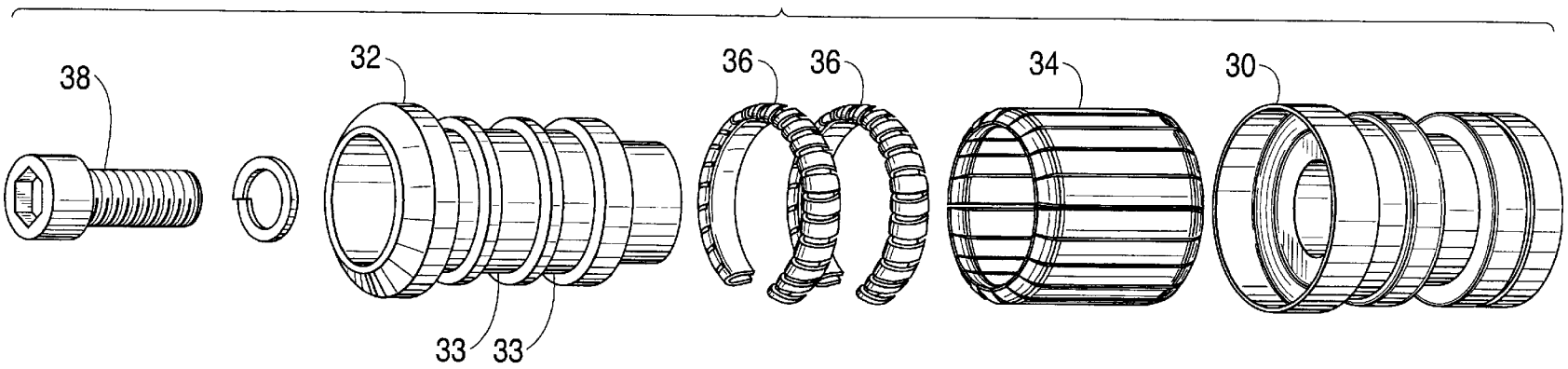
FIG. 7 is an exploded view of a connector assembly according to the embodiment of FIG. 1.

The multiple finger spring rings 36 can be seen in greater detail in FIG. 7. The multiple finger spring rings 36 are made from a linear piece of spring stock which has a flat metallic portion, with a plurality of individual finger spring elements bent back from the flat portion. This linear spring element is bent into the C shape shown in FIG. 7 and is then slid into respective grooves 33. Installation of the multiple finger contact 34 over the multiple finger spring rings 36 presses the multiple finger spring rings 36 so they each form essentially a full circular ring seated within their respective groove 33.

FIG. 7 further shows an exploded view of the components of the connector 10. In a preferred embodiment, the parts are assembled as follows. First, the multiple finger spring rings 36 are curved into a C shape to fit into grooves 33 of the connector sleeve 32. The multiple finger contact 34 is then pushed over the small end of the connector sleeve 32 with the free ends 46 expanding over each of the multiple finger spring rings 36 as they are pushed over them. The multiple finger contact 34 now encircles and captivates the multiple finger spring rings 36, retaining them in the grooves 33. Correspondingly, the multiple finger spring rings 36 provide an outward radial restoring force in response to compression of the multiple finger contact 34 in the installed condition. To further assemble the connecting device 10, the subassembly comprising the above elements is set into the end of the inner connector body 30, FIG. 1, and is bolted in place 38. The connector body can now be fitted within an anchor insulator 28 (see FIG. 1) and fixed inside the end of the first coaxial inner conductor 14 (see FIG. 1).

The various components described above can be made of any suitable materials. However, in one preferred embodiment, the inner connector body 30 is made from copper. The connector sleeve 32 is made from aluminum. The multiple finger contact 34 is a brass silver plated item. The multiple finger spring rings 36 are beryllium copper springs. These C-shaped spring rings 36, as discussed above, are made by bending into a C-shape a linear beryllium copper finger spring which is commercially available. Although two grooves 33 and two spring rings 36 are described in a preferred embodiment, the number of springs 36 and corresponding grooves 33 may be varied to provide suitable spring back.

Referring back to FIG. 1, it will be appreciated that the assembly 10 provides an advantageous arrangement for connecting first and second inner coaxial conductors. By virtue of the multiple finger contact 34, used in combination with the multiple finger spring rings 36, the connector may be easily slid into the second coaxial inner conductor 18 with a suitably low insertion force. Also, since the multiple finger spring rings 36 resiliently support the multiple finger contact 34 in the radial direction, the combination of the multiple finger spring rings 36 with the multiple finger contact 34 provides suitable contact force to provide a desired electrical connection with the inner surface of the second coaxial inner conductor 16.

In some preferred embodiments, a hood 31 may be provided as shown to trap particles that might occur due to wear from frictional relative contact occurring between the various parts of the connector. In many embodiments, the second coaxial section 15 will be vertically oriented above the first coaxial transmission line section 11. The conductors 14 and 18 may move axially relative to each other during use of the assembled coaxial line sections. The axial movement may be due to thermal growth from the environment or from power cycling. By virtue of the hood 31, any metallic particles resulting from wear due to frictional sliding within the various components of the connector will remain trapped within the area defined by the hood 31, and will not disperse and collect on other areas such as the anchor insulator 28. This provides an additional advantage of the invention by avoiding undesirable conductive material coming to rest on the insulator, even when frequent axial movement occurs between the inner conductors, due to, for example, thermal changes or power cycling.

The many features and advantages of the invention are apparent from the detailed specification, and thus, it is intended by the appended claims to cover all such features and advantages of the invention which fall within the true spirits and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. An apparatus for connecting a first coaxial transmission line section having a first coaxial outer conductor and a first coaxial inner conductor to a second coaxial transmission line section having a second coaxial outer conductor and a second coaxial inner conductor, the apparatus comprising:

an inner conductor body mounted to the first coaxial inner conductor;

a connector sleeve mounted to the inner conductor body;

an annular multiple finger contact element mounted to said connector sleeve, and surrounding at least a portion of said connector sleeve, said multiple finger contact element having a total axial length and being deformable in a radial direction along the entire total axial length; and a first annular multiple finger spring ring disposed between said connector sleeve and said multiple finger contact to resiliently radially support said multiple finger contact, wherein said multiple finger contact is insertable into said second coaxial inner conductor to provide a contact with said second coaxial inner conductor.

2. An apparatus according to claim 1, wherein said first multiple finger spring ring is disposed in a first groove in said connector sleeve.

3. An apparatus according to claim 1, wherein said connector sleeve is bolted to said inner conductor body.

4. An apparatus claim 1, further comprising a second multiple finger spring ring disposed in a second groove in said connector sleeve.

5. An apparatus according to claim 1, wherein an anchor insulator extends radially from said inner conductor body to the first and second coaxial outer conductor, and said inner conductor body is supported in the enter of the anchor insulator.

6. An apparatus according to claim 1, further comprising a first flange on the first coaxial transmission line section and a second flange on the second coaxial transmission line section, and a fastener for connecting the first and second flanges to each other.

7. An apparatus according to claim 6, further comprising an O-ring disposed between the first and second flanges seal an interior of the first and second coaxial line sections.

8. An apparatus according to claim 1, wherein said inner conductor body has a first end adjacent to said connector sleeve, and said first end comprises a hood element extending therefrom and at least partially surrounding a portion of said multiple finger contact.

9. An apparatus for connecting a first coaxial transmission line section having a first coaxial outer conductor and first coaxial inner conductor to a second coaxial transmission line section having a second coaxial outer conductor and a second coaxial inner conductor, the apparatus comprising:

an inner conductor body mounted to the first coaxial inner conductor;

a connector sleeve mounted to the inner conductor body;

an annular multiple finger contact element mounted to said connector sleeve, and surrounding at least a portion of said connector sleeve, said multiple finger contact having a first end that comprises a rigid ring retained axially by fitting between said connector sleeve and said inner conductor body, a second end distal from said first end, and a plurality of fingers extending from the first end along the entire total axial length of the contact element and that are radially movable to expand or contract the radial dimension of said multiple finger contact; and a first annular multiple finger spring ring disposed between said connector sleeve and said multiple finger contact to resiliently radially support said multiple finger contact, wherein said multiple finger contact is insertable into said second coaxial inner conductor to provide a contact with said second coaxial inner conductor.

10. An apparatus for connecting a first coaxial transmission line section having a first coaxial outer conductor and first coaxial inner conductor to a second coaxial transmission line section having a second coaxial outer conductor and a second coaxial inner conductor, the apparatus comprising:

an inner conductor body mounted to the first coaxial inner conductor;

a connector sleeve mounted to the inner conductor body; and an annular multiple finger contact element mounted to said connector sleeve, and surrounding at least a portion of said connector sleeve, wherein said multiple finger contact is insertable into said second coaxial inner conductor to provide a contact with said second coaxial inner conductor; and wherein said inner conductor body has a first end adjacent to said connector sleeve, and said first end comprises a hood element extending therefrom and at least partially surrounding a portion of said multiple finger contact.

11. A method of connecting a first coaxial transmission line section having a first outer conductor and a first inner conductor to a second coaxial transmission line having a second outer conductor and a second inner conductor, comprising the steps of:

inserting a contact element attached to the first inner conductor into the second inner conductor; and providing a hood at least partially surrounding the contact element to collect particles disposed by wear between the contact element and the first inner conductor.

12. An apparatus for correcting a first coaxial transmission line section having a first coaxial outer conductor and a first coaxial inner conductor to a second coaxial transmission line section having a second coaxial outer conductor and a second coaxial inner conductor, the apparatus comprising:

an inner conductor body mounted to the first coaxial inner conductor;

a connector sleeve mounted to the inner conductor body;

deformable means for contracting the second coaxial inner conductor, mounted to the connector sleeve and having a total axial length, and surrounding at least a portion of the connector sleeve, said deformable means having a free end and being deformable in the radial direction along the entire total axial length of the contacting means; and first supporting means disposed between the connector sleeve and the deformable contacting means for resiliently supporting the contacting means, wherein the contacting means is insertable into the second coaxial inner conductor to provide a contact with the second coaxial inner conductor; and wherein the free ends of the deformable contacting means comprising said radially deformable contacting means are disposed in a groove in said connector sleeve.

13. An apparatus for connecting a first coaxial transmission line section having a first coaxial outer conductor and a first coaxial or conductor to a second coaxial transmission line section having a second coaxial outer conductor and a second coaxial inner conductor, the apparatus comprising:

an inner conductor body mounted to the first coaxial inner conductor;

a connector sleeve mounted to the inner conductor body;

deformable means for contacting the second coaxial inner conductor, mounted to the connector sleeve and having a total axial length, and surrounding at least a portion of the connector sleeve, said deformable means being deformable in the radial direction along the entire total axial length of the contacting means;

supporting means disposed between the connector sleeve and the deformable contacting means for resiliently supporting the contacting means; and contacting means insertable into the second coaxial inner conductor to provide a contact with the second coaxial inner conductor, wherein said connector sleeve is bolted to said inner conductor body.

14. An apparatus for connecting a first coaxial transmission line section having a first coaxial outer conductor and a first coaxial inner conductor to a second coaxial transmission line section having a second coaxial outer conductor and a second coaxial inner conductor, the apparatus comprising:

an inner conductor body mounted to the first coaxial inner conductor;

a connector sleeve mounted to the inner conductor body;

deformable means for contacting the second coaxial inner conductor, mounted to the connector sleeve and having a total axial length, and surrounding at least a portion of the connector sleeve, said deformable means being deformable in the radial direction along the entire total axial length of the contacting means;

first supporting means dispose between the connector sleeve and the deformable contacting means for resiliently supporting the contacting means, wherein the deformable contacting means is insertable into the second coaxial inner conductor to provide a contact with the second coaxial inner conductor; and wherein said inner conductor body has a first end adjacent to said connector sleeve, and said first end comprises a hood element extending therefrom, and at least partially surrounding a portion of said deformable contacting means.

15. An apparatus for connecting a first coaxial transmission line section having a first coaxial outer conductor and a first coaxial inner conductor to a second coaxial transmission line section having a second coaxial outer conductor and a second coaxial inner conductor, the apparatus comprising:

an inner conductor body mounted to the first coaxial inner conductor;

a connector sleeve mounted to the inner conductor body;

deformable means for connecting the second coaxial inner conductor, mounted to the connector sleeve and having a total axial length, and surrounding at least a portion of the connector sleeve, said deformable means being deformable in the radial direction along the entire total axial length of the contacting means;

first supporting means disposed between the connector sleeve and the deformable contacting means for resiliently supporting the contacting means, wherein the contacting mete is insertable into the second coaxial inner conductor to provide a contact with the second coaxial inner conductor; and further comprising a second supporting means disposed in a second groove in said connector sleeve.

16. A method for connecting a first coaxial transmission line section having a first coaxial outer conductor and a first coaxial inner conductor to a second coaxial transmission line section having a second coaxial outer conductor and a second coaxial inner conductor, the method comprising the steps of:

contacting the second coaxial inner conductor to provide a contact with the second coaxial inner conductor by a multiple finger contact element mounted to a connector sleeve mounted to an inner conductor body connected to the first coaxial inner conductor, the multiple finger contact element surrounding at least a portion of the connector sleeve, and being deformable in the radial direction along the entire total axial length of the multiple finger contact; and resiliently supporting the multiple finger contact by a multiple finger spring ring disposed between the connector sleeve and the multiple finger contact element.

17. A method according to claim 16, further comprising the step of supporting the inner conductor body in the center of an anchor insulator which extends radially outward from the inner conductor body to the first coaxial outer conductor.

18. A method according to claim 16, wherein free ends of the fingers comprising the multiple finger contact element are in the connector sleeve.

19. A method according to claim 16, further comprising the step of supporting the inner conductor body in the center of an anchor insulator which extends radially outward from the inner conductor body to the first and second coaxial outer conductor.

20. A method according to claim 16, wherein the contacting step comprises flexing a plurality of fingers that are radially movable to expand or contract the multiple finger contact element in the radial direction.

* * * * *